US009022539B2

(12) United States Patent
Kobayashi et al.

(10) Patent No.: US 9,022,539 B2
(45) Date of Patent: May 5, 2015

(54) INK CARTRIDGE PROVIDED WITH AIR COMMUNICATION PORTION

(71) Applicants: Tetsuro Kobayashi, Nagoya (JP); Toyonori Sasaki, Anjo (JP)

(72) Inventors: Tetsuro Kobayashi, Nagoya (JP); Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/088,551

(22) Filed: Nov. 25, 2013

(65) Prior Publication Data

US 2014/0168325 A1 Jun. 19, 2014

(30) Foreign Application Priority Data

Dec. 18, 2012 (JP) ..... 2012-275337
Dec. 18, 2012 (JP) ..... 2012-275339

(51) Int. Cl.
*B41J 2/175* (2006.01)

(52) U.S. Cl.
CPC ..... *B41J 2/17556* (2013.01); *B41J 2/17513* (2013.01)

(58) Field of Classification Search
None
See application file for complete search history.

(56) References Cited

U.S. PATENT DOCUMENTS

| | | | |
|---|---|---|---|
| 8,177,343 | B2 | 5/2012 | Yoshiike |
| 8,272,724 | B2 | 9/2012 | Kanbe |
| 2010/0194830 | A1 | 8/2010 | Yoshiike |
| 2010/0231667 | A1 | 9/2010 | Kanbe |

FOREIGN PATENT DOCUMENTS

| | | | |
|---|---|---|---|
| JP | 2009-096126 | A | 5/2009 |
| JP | 2010-214687 | A | 9/2010 |

*Primary Examiner* — Geoffrey Mruk
*Assistant Examiner* — Bradley Thies
(74) *Attorney, Agent, or Firm* — Banner & Witcoff, Ltd.

(57) ABSTRACT

An ink cartridge includes a cartridge body, an ink supply portion and an air communication portion provided at the cartridge body, a block member and a slider. The air communication portion has an inner peripheral wall defining an air passage, and a communication port for allowing communication between an ink chamber and the air passage. The block member moves from a first position to a second position by contact with the slider sliding in a sliding direction to block and open the air passage. The slider includes: a first cylindrical portion having an upstream through-hole penetrating therethrough; a second cylindrical portion having a downstream through-hole penetrating therethrough and communicating with the upstream through-hole; and a semipermeable membrane closing the upstream through-hole. The slider has a contact portion in close contact with the inner peripheral wall and positioned upstream of the block member at the first position in the sliding direction.

6 Claims, 10 Drawing Sheets

51
36
32
90
117
120
128
130
124
126
119
129
96
131
136
135
125
137
127
133
134
116
132
121
122
55
50
56
53

INK CARTRIDGE PROVIDED WITH AIR COMMUNICATION PORTION

CROSS REFERENCE TO RELATED APPLICATION

This application claims priority from Japanese Patent Application Nos. 2012-275337 filed Dec. 18, 2012 and 2012-275339 filed Dec. 18, 2012. The entire contents of the priority applications are incorporated herein by reference.

TECHNICAL FIELD

The present invention relates to an ink cartridge provided with an ink chamber and air communication portion that permits the ink chamber to communicate with ambient air to bring pressure of the ink chamber into atmospheric pressure.

BACKGROUND

There is known an image recording apparatus that uses ink to record an image onto a recording sheet. This image recording apparatus includes an inkjet type recording head and is configured to selectively spray ink droplets from the recording head toward a recording sheet. The ink droplets are landed onto the recording sheet and thereby a desired image is recorded on the recording sheet. The image recording apparatus is provided with an accommodating portion configured to accommodate an ink cartridge that stores ink to be supplied to the recording head.

The ink cartridge to be attached to the image recording apparatus is internally sealed, before use, so as to prevent ink stored inside the ink cartridge from leaking outside. Interior of the ink cartridge is brought into atmospheric pressure when used. To this end, a valve mechanism for opening and closing an air communication portion is conventionally provided in the ink cartridge. Specifically, a conventional valve mechanism provided in the air communication portion has a valve body and a coil spring that biases the valve body in a direction closing the air communication portion. When the ink cartridge is accommodated in the accommodating portion, a rod provided in the accommodating portion presses the valve body against a biasing force of the coil spring to open the air communication portion.

SUMMARY

With the valve mechanism having the above configuration, when the ink cartridge is removed from the accommodating portion, the air communication portion is closed once again, thereby preventing the ink from leaking therefrom. Thus, this valve mechanism can open and close the air communication portion in a reversible manner. However, this valve mechanism involves a large number of parts and results in a complicated configuration.

In view of the foregoing, it is an object of the present invention to provide an ink cartridge provided with an air communication portion that allows an ink chamber to communicate with ambient air with a simple structure.

In order to attain the above and other objects, there is provided an ink cartridge including a cartridge body, an ink supply portion, an air communication portion, a block member and a slider. The cartridge body defines an ink chamber therein for storing ink. The ink supply portion is provided at the cartridge body and is configured to supply the ink stored in the ink chamber to outside. The air communication portion is provided at the cartridge body, the air communication portion having an inner peripheral wall that defines an air passage and a communication port configured to allow communication between the ink chamber and the air passage, the air communication portion having an aperture exposed to outside and in communication with the air passage for introducing air into the air passage. The block member is configured to move from a first position to a second position, the block member at the first position being disposed in the air passage and configured to block the air passage, the block member at the second position being configured to open the air passage. The slider is configured to contact the block member and slide in a sliding direction along the air passage, wherein the block member is configured to be moved from the first position to the second position by the slider sliding in the sliding direction while contacting the block member. The slider includes a first cylindrical portion, a second cylindrical portion and a semipermeable membrane. The first cylindrical portion has an upstream through-hole formed therein to penetrate the first cylindrical portion in the sliding direction, the upstream through-hole having a cross-sectional area larger than a cross-sectional area of the air passage when viewed in the sliding direction, the first cylindrical portion having an upstream end at which the upstream through-hole is opened. The second cylindrical portion is provided downstream of the first cylindrical portion in the sliding direction and has a downstream through-hole formed therein to penetrate the second cylindrical portion in the sliding direction such that the downstream through-hole and the upstream through-hole are in communication with each other, the second cylindrical portion having a downstream end at which the downstream through-hole is opened to be communicable with the air passage, the second cylindrical portion having a contact portion configured to be in close contact with the inner peripheral wall of the air communication portion at a position upstream of the block member at the first position in the sliding direction. The semipermeable membrane is provided at the upstream end of the first cylindrical portion to seal the upstream through-hole.

According to another aspect of the present invention, there is provided an ink cartridge including a cartridge body, an ink supply portion, an air communication portion, a block member, and a slider. The cartridge body defines an ink chamber therein for storing ink. The ink supply portion is provided at the cartridge body and is configured to supply the ink stored in the ink chamber to outside. The air communication portion is provided at the cartridge body, the air communication portion having an inner peripheral wall that defines an air passage and a communication port configured to allow communication between the ink chamber and the air passage, the air communication portion having an aperture exposed to outside and in communication with the air passage for introducing air into the air passage. The block member is configured to move from a first position to a second position, the block member at the first position being disposed in the air passage and configured to block the air passage, the block member at the second position being configured to open the air passage. The slider is configured to contact the block member and slide in a sliding direction, the block member being configured to be moved irreversibly from the first position to the second position by the slider sliding in the sliding direction while contacting the block member, the inner peripheral wall of the air communication portion extending in the sliding direction and the communication port being formed in the inner peripheral wall, the block member at the first position having a portion positioned between the aperture and the communication port.

DETAILED DESCRIPTION

First Embodiment

Figure 1:
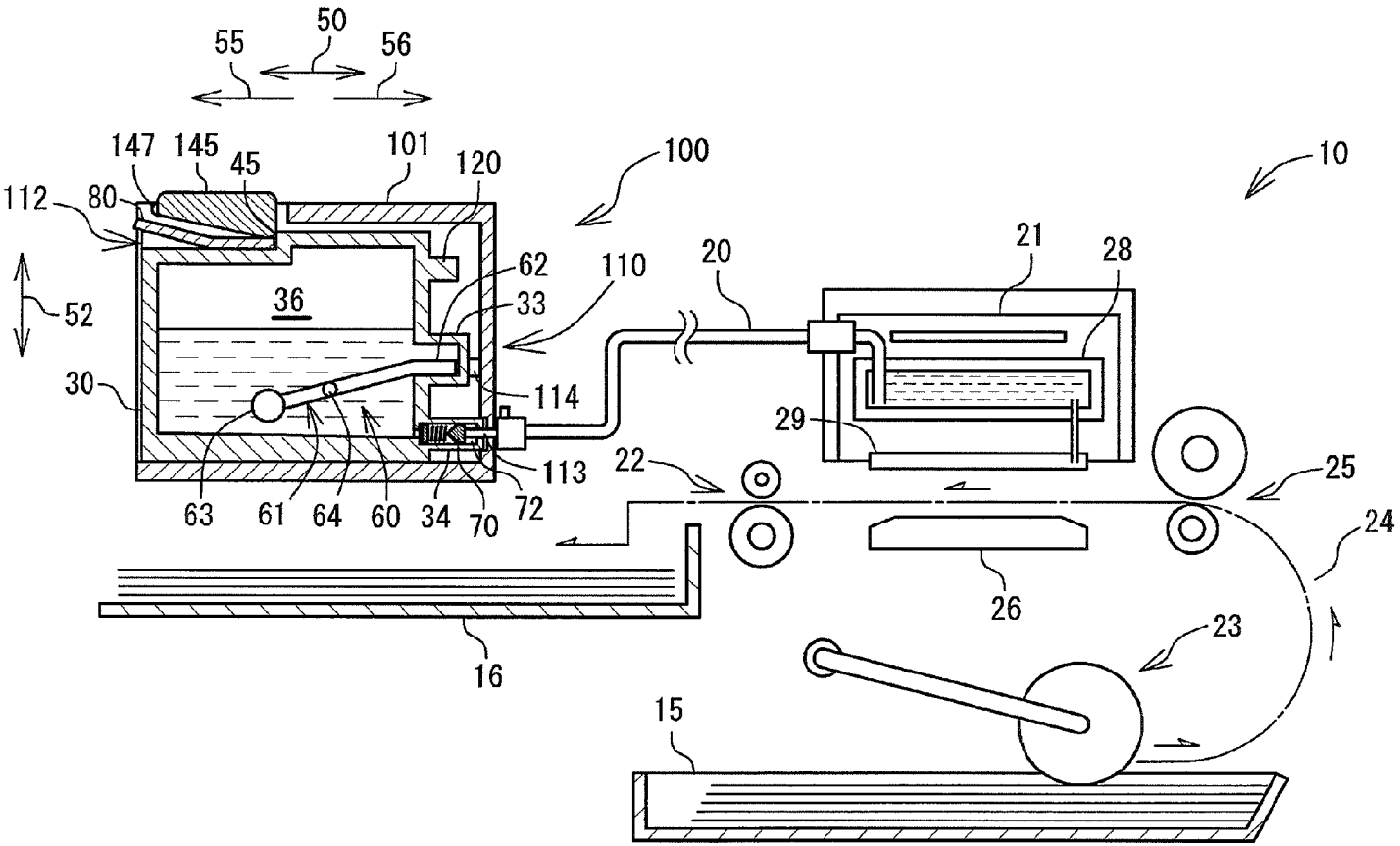
FIG. 1 is a conceptual cross-sectional diagram showing an internal construction of a printer provided with an ink supply device that detachably accommodates an ink cartridge according to a first embodiment of the present invention.

An ink cartridge 30 according to a first embodiment of the present invention will be described with reference to FIGS. 1 through 5B.

1. Overall Structure of Printer

First, a printer 10 adapted to accommodate the ink cartridge 30 according to the first embodiment will be described with reference to FIG. 1.

The printer 10 is configured to form an image by ejecting ink droplets onto a sheet in accordance with an ink jet recording system. As shown in FIG. 1, the printer 10 includes an ink supply device 100 provided with a cartridge accommodating section 110 configured to detachably accommodate the ink cartridge 30 therein. The cartridge accommodating section 110 has one side formed with an opening 112 exposed to an atmosphere. The ink cartridge 30 can be inserted into and removed from the cartridge accommodating section 110 through the opening 112.

The ink cartridge 30 stores therein an ink to be used in the printer 10. The printer 10 further includes a recording head 21 connectable to the ink cartridge 30 through an ink tube 20 when the ink cartridge 30 is mounted in the cartridge accommodating section 110. The recording head 21 has a sub tank 28 in which the ink supplied from the ink cartridge 30 through the ink tube 20 is temporarily stored. The recording head 21 also includes a plurality of nozzles 29 through which ink supplied from the sub tank 28 is selectively ejected in accordance with the ink jet recording system.

The printer 10 also includes a sheet supply tray 15, a sheet supply roller 23, a sheet path 24, a pair of transfer rollers 25, a platen 26, a pair of discharge rollers 22, and a discharge tray 16. A sheet of paper is supplied from the sheet supply tray 15 to the sheet passage 24 by the sheet supply roller 23, and is then conveyed to the platen 26 by the pair of transfer rollers 25. Then, the ink is selectively ejected from the recording head 21 onto the sheet passing through the platen 26 to form an inked image on the sheet. The sheet is then discharged onto the discharge tray 16 by the pair of discharge rollers 22.

2. Ink Supply Device

The ink supply device 100 functions to supply ink to the recording head 21, as shown in FIG. 1. As described above, the ink supply device 100 includes the cartridge accommodating section 110 in which the ink cartridge 30 is detachable loadable.

FIG. 1 shows a state where the ink cartridge 30 has been loaded in the cartridge accommodating section 110. In the printer 10 of the present embodiment, the cartridge accommodating section 110 is configured to accommodate four kinds of ink cartridges 30 corresponding to four colors of cyan, magenta, yellow and black, respectively. However, for explanatory purpose, FIG. 1 depicts the cartridge accommodating section 110 that has accommodated only one ink cartridge 30 therein.

Figure 2:
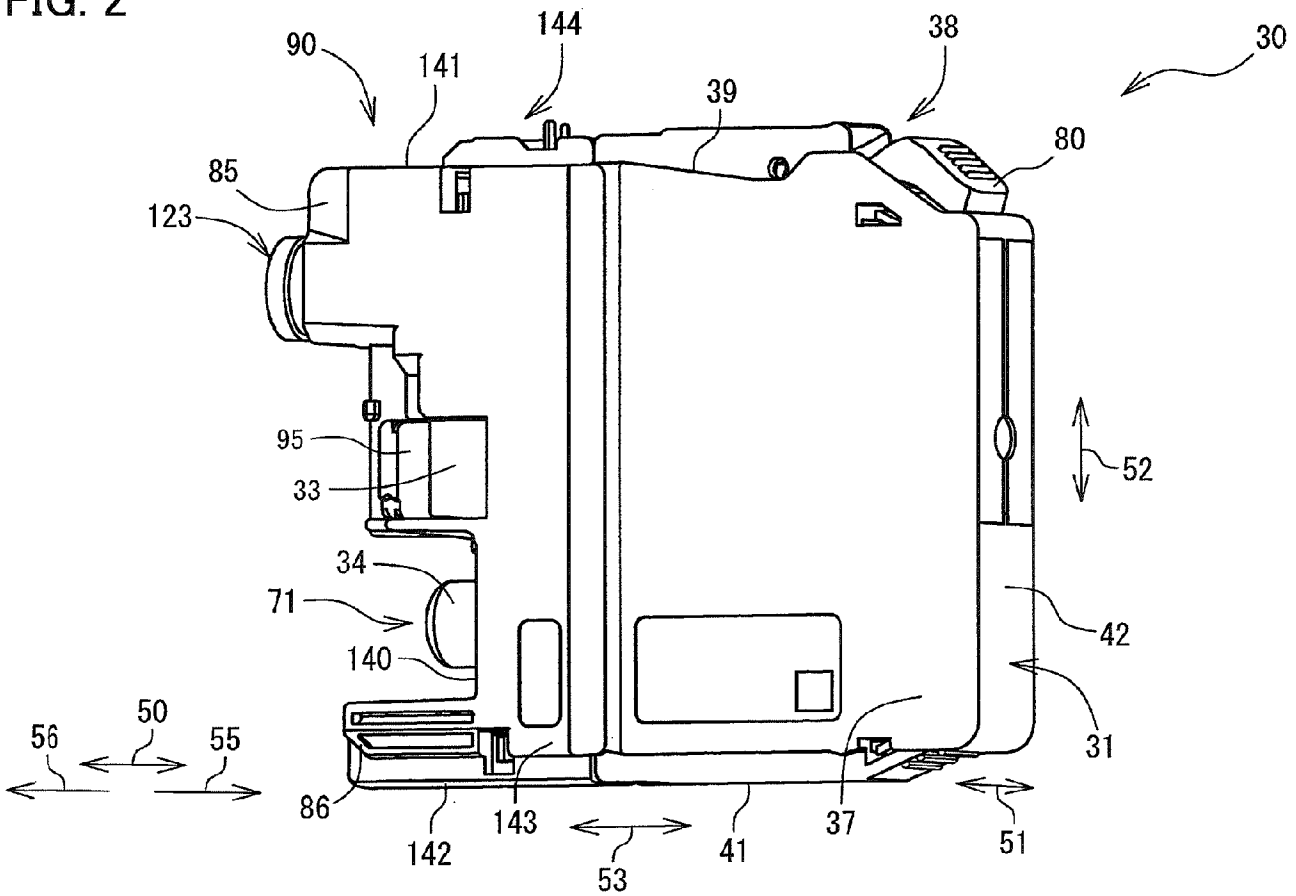
FIG. 2 is a perspective view showing an external appearance of the ink cartridge according to the first embodiment.
Figure 3:
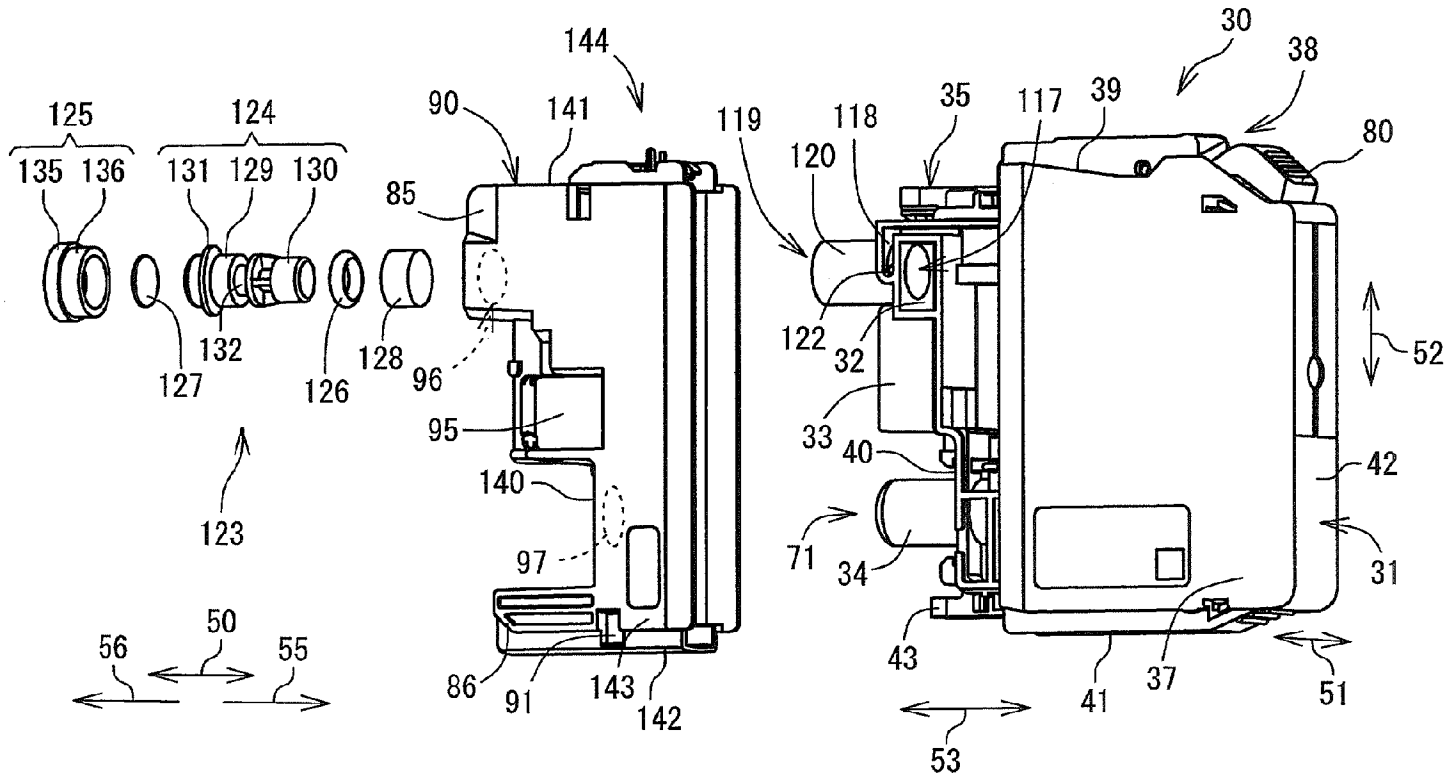
FIG. 3 is an exploded perspective view showing the external appearance of the ink cartridge according to the first embodiment, the ink cartridge including a cartridge body, an inner frame housed in the cartridge body and a bracket assembled to the cartridge body.
Figure 4:
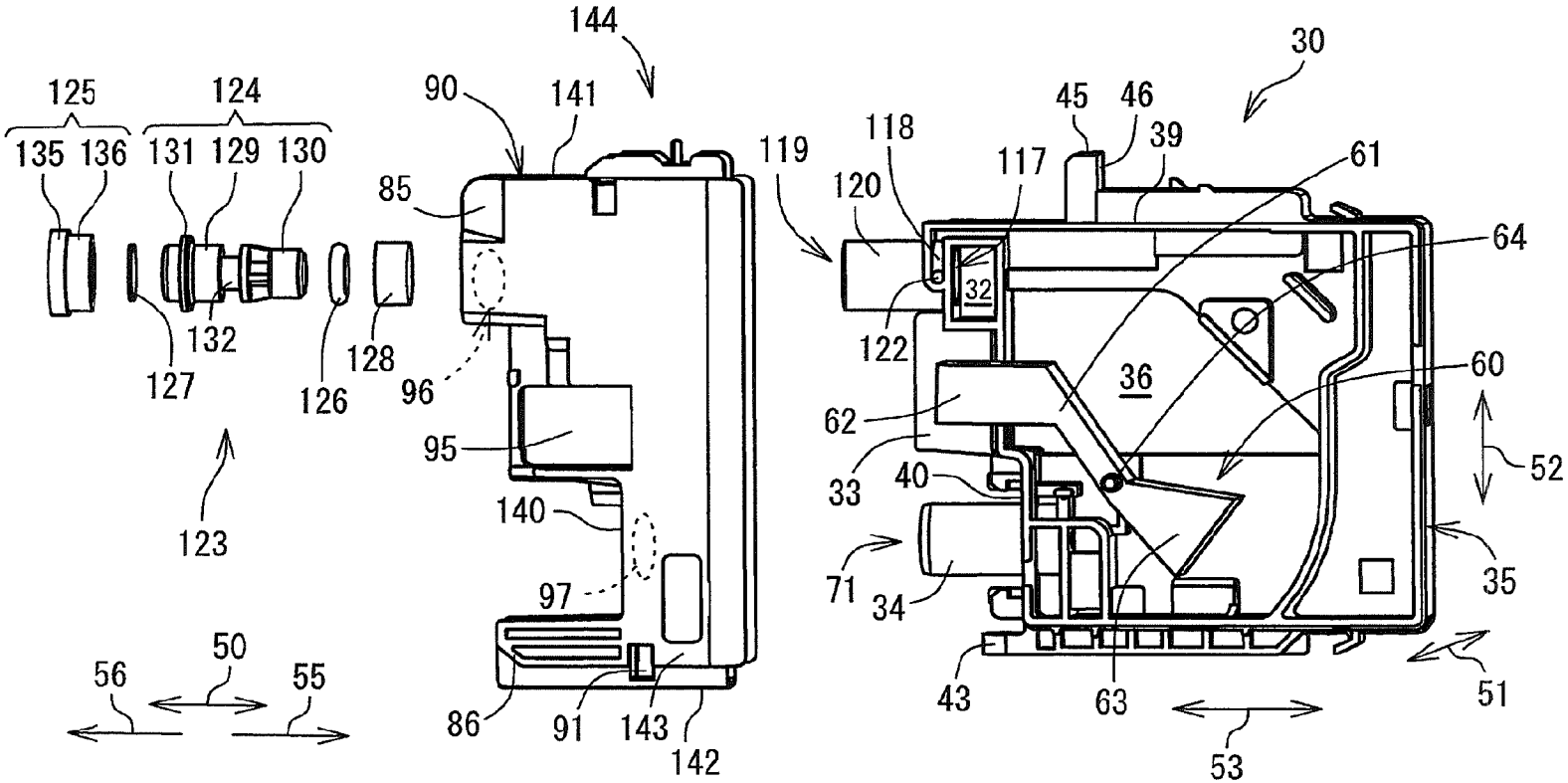
FIG. 4 is an exploded side view of the ink cartridge according to the first embodiment, wherein the inner frame is exposed to show an air communication portion according to the first embodiment.

The ink cartridge 30 is mounted in and removed from the cartridge accommodating section 110 in an upstanding posture shown in FIGS. 2 to 4. Specifically, the ink cartridge 30 is loaded into the cartridge accommodating section 110 in a loading direction 56, and is unloaded from the cartridge accommodating section 110 in an unloading direction 55 while maintaining the upstanding posture. Hereinafter, the loading direction 56 and the unloading direction 55 may be collectively referred to as a loading/unloading direction 50, whenever necessary, assuming that the loading direction 56 and the unloading direction 55 are interchangeable with each other.

The cartridge accommodating section 110 includes a case 101, an engaging member 145, an ink needle 113 and an optical sensor 114.

The case 101 defines an outer profile of the cartridge accommodating section 110. The ink cartridge 30 is accommodated in the case 101. The case 101 has an end wall opposite the opening 112.

The ink needle 113 is tubular shaped and is formed of a resin. The ink needle 113 is connected to the ink tube 20. The ink needle 113 is disposed at a lower end portion of the end wall of the case 101 to correspond to an ink supply portion 34 (described later) of the ink cartridge 30 mounted in the cartridge accommodating section 110. The ink needle 113 is inserted into an ink supply outlet 71 of the ink supply portion 34 (see FIGS. 2 to 4) when the ink cartridge 30 is being mounted in the cartridge accommodating section 110, thereby opening an ink supply valve 70 provided in the ink supply portion 34. As a result, the ink stored in an ink chamber 36 of the ink cartridge 30 is flowed out therefrom, through an ink passage 72 formed in the ink supply portion 34, into the ink tube 20 connected to the ink needle 113.

The optical sensor 114 is provided on the end wall of the case 101 at a position upward of the ink needle 113 in a gravity direction. The optical sensor 114 includes a light-emitting element (LED, for example) and a light-receiving element (phototransistor, for example). The optical sensor 114 has a horseshoe-shaped housing. The light-emitting element and the light-receiving element are disposed respectively on distal end portions of the horseshoe-shaped housing of the optical sensor 114 to oppose each other. In the present embodiment, the light-emitting element is configured to emit light in a horizontal direction (perpendicular to the loading/unloading direction 50) and the light-receiving element is configured to receive the light emitted from the light-emitting element. The light-emitting element and the light-receiving element define a space therebetween into which a detecting portion 33 of the ink cartridge 30 enters when the ink cartridge 30 is loaded into the cartridge accommodating section 110, as will be described later. When entering this space, the detecting portion 33 alters a path of light formed between the light-emitting element and the light-receiving element, thereby enabling the optical sensor 114 to detect changes in amount of light received by the light-receiving element.

Further, as shown in FIG. 1, the engaging member 145 is provided on an upper wall of the casing 101 at a position adjacent to the opening 112. Four engaging members 145 are provided for receiving four ink cartridges 30 in the present embodiment, but for explanatory purpose, only one engaging member 145 is depicted in FIG. 1. The engaging member 145 is configured to pivot about a shaft 147 provided near the opening 112 on the upper wall. When the ink cartridge 30 is mounted in the cartridge accommodating section 110, the engaging member 145 is configured to engage an engaging portion 45 of the ink cartridge 30 to keep the ink cartridge 30 mounted in the cartridge accommodating section 110 against a biasing force acting in the unloading direction 55, as will be described later.

For removing the ink cartridge 30 from the cartridge accommodating section 110, a user pushes down a rear end portion of a pivot member 80 (described later) provided on the ink cartridge 30 to cause the engaging member 145 to pivotally move counterclockwise. The engagement between the engaging member 145 and the engaging portion 45 is thus released by the pivotal movement of the pivot member 80, thereby permitting the ink cartridge 30 from being removed from the cartridge accommodating section 110.

3. Ink Cartridge

The ink cartridge 30 is a container that stores ink therein. The ink cartridge 30 defines therein a space for storing ink and this space serves as the ink chamber 36. In the present embodiment, as shown in FIGS. 2 to 4, the ink chamber 36 is formed by an inner frame 35 accommodated in a cartridge body 31 that constitutes a portion of an outer profile of the ink cartridge 30. Alternatively, the ink chamber 36 may be defined by the cartridge body 31 itself.

The ink cartridge 30 includes the cartridge body 31, a bracket 90, and the inner frame 35 that defines the ink chamber 36, as shown in FIGS. 2 to 4.

The cartridge body 31 has a generally flat rectangular parallelepiped shape in outer appearance. The cartridge body 31 has a width (in a direction indicated by an arrow 51 which will be referred to as widthwise direction), a height (in a direction indicated by an arrow 52 which will be referred to as height direction or vertical direction) and a depth (in a direction indicated by an arrow 53 which will be referred to as depthwise direction, the height and depth being greater than the width.

The loading/unloading direction 50 of the ink cartridge 30 relative to the cartridge accommodating section 110 is coincident with the horizontal direction, or the depthwise direction 53 in the present embodiment. However, the loading and unloading of the ink cartridge 30 relative to the cartridge accommodating section 110 may be performed in a direction parallel to a vertical direction, or a direction intersecting with both of the vertical and horizontal directions.

The bracket 90 is assembled to the cartridge body 31 to form the outer profile of the ink cartridge 30. The inner frame 35 is housed within the cartridge body 31 and the bracket 90 assembled to each other.

(3-1) Cartridge Body

Hereinafter, whenever necessary, directions with respect to the ink cartridge 30 will be defined based on the upstanding posture shown in FIG. 2. That is, a leading side of the ink cartridge 30 when the ink cartridge 30 is inserted into the cartridge accommodating section 110 in the loading direction 56 is referred to as the front side of the ink cartridge 30, whereas a trailing side of the ink cartridge 30 in the unloading direction 55 is referred to as the rear side of the ink cartridge 30.

The cartridge body 31 is box-like shaped to have a hollow space defined therein for housing the inner frame 35. The cartridge body 31 includes a pair of side walls 37 and 38 opposed to each other in the widthwise direction 51 and upper and lower walls 39 and 41 opposed to each other in the height direction 52. The cartridge body 31 also includes a rear wall 42 that serves as the trailing end of the ink cartridge 30 in the loading direction 56. The four walls 37, 38, 39, and 41 extend from the rear wall 42 in the loading direction 56. The cartridge body 31 is also formed with an open surface opposed to the rear wall 42 in the depthwise direction 53. The inner frame 35 is inserted into the space formed inside the cartridge body 31 through this open surface. When the inner frame 35 is accommodated in the cartridge body 31, the inner frame 35 is partially exposed from the cartridge body 31, as shown in FIG. 3. That is, the cartridge body 31 covers a rear portion of the inner frame 35.

As illustrated in FIG. 1, the pivot member 80 is provided on the upper wall 39 of the cartridge body 31. The pivot member 80 has a bent plate-like shape and is disposed to extend in the depthwise direction 53. The pivot member 80 has a bent portion in which a pivot shaft (not illustrated) is provided. The pivot member 80 is configured to pivot about this pivot shaft. The pivot member 80 has a portion extending from the bent portion toward an engaging surface 46 formed in the engaging portion 45 of the cartridge body 31 (described later), and another portion extending from the bent portion toward the rear wall 42. That is, the pivot member 80 is configured of a portion frontward of the pivot shaft (frontward portion) and another portion rearward of the pivot shaft (rearward portion). When the ink cartridge 30 is loaded in the cartridge accommodating section 110, the frontward portion of the pivot member 80 is positioned below the engaging member 145.

The rearward portion of the pivot member 80 is pressed down by a user when the ink cartridge 30 is removed from the cartridge accommodating section 110 to release the engagement between the engaging member 145 and the engaging portion 45.

(3-2) Bracket

The bracket 90 has a box-like shape and is configured of a pair of side walls 143 and 144 opposed to each other in the widthwise direction 51, and upper and lower walls 141 and 142 opposed to each other in the height direction 52. The bracket 90 also has a front wall 140 that opposes the rear wall 42 of the cartridge body 31 in the depthwise direction 53 when the bracket 90 is assembled to the cartridge body 31. This front wall 140 serves as the leading end of the ink cartridge 30 when the ink cartridge 30 is being mounted in the cartridge accommodating section 110 in the loading direction 56. The four walls 143, 144, 141, and 142 extend from the front wall 140 in the depthwise direction 53. The bracket 90 also has an open surface opposed to the front wall 140 in the depthwise direction 53. The inner frame 35 is inserted inside the bracket 90 through this open surface. That is, the bracket 90 covers a front portion of the inner frame 35 that is not covered by the cartridge body 31.

When the bracket 90 is assembled to the cartridge body 31, the upper wall 141 of the bracket 90 and the upper wall 39 of the cartridge body 31 are in continuous with each other to constitute an upper wall of the ink cartridge 30. Similarly, the lower wall 142 of the bracket 90 and the lower wall 41 of the cartridge body 31 are in continuous with each other to constitute a lower wall of the ink cartridge 30. The side walls 143 and 144 of the bracket 90 and the side walls 37 and 38 of the cartridge body 31 constitute side walls of the ink cartridge 30, respectively. Further, in the assembled state of the ink cartridge 30, the front wall 140 of the bracket 90 constitutes a front wall of the ink cartridge 30 and the rear wall 42 of the cartridge body 31 constitutes a rear wall of the ink cartridge 30.

In the present embodiment, the direction in which the front and rear walls of the ink cartridge 30 (front wall 140 and rear wall 42) oppose each other (i.e., depthwise direction 53) is the front-rear direction (horizontal direction) and coincides with the loading/unloading direction 50. Thus, the direction in which the upper and lower walls of the ink cartridge 30 (upper walls 141, 39 and lower walls 142, 41) oppose each other (i.e., height direction 52) is coincident with the vertical direction (gravity direction).

A through-hole 95 is formed in the bracket 90 to penetrate each of the side walls 143 and 144 in the widthwise direction 51 at a position substantially center in the height direction 52 and adjacent to the front wall 140. The through-hole 95 functions to expose the detecting portion 33 of the inner frame 35 when the inner frame 35 is accommodated in the bracket 90. Thus, the through-hole 95 is formed so as to correspond to the detection portion 33 of the inner frame 35 in terms of position, dimension, and shape.

An elongated hole 91 is also formed in a lower end portion of each of the side walls 143, 144 of the bracket 90. When the bracket 90 is assembled to the cartridge body 31 in which the inner frame 35 is accommodated, these elongated holes 91 are configured to engage with engagement claws 43 provided on the inner frame 35.

The front wall 140 is formed with a hole 96 upward of the through-hole 95 in the height direction 52. The hole 96 penetrates the front wall 140 in the depthwise direction 53. The hole 96 serves to allow communication between an air communication portion 120 (described later) and outside when the inner frame 35 has been accommodated in the bracket 90. Thus, the hole 96 is formed so as to correspond to the air communication portion 120 in terms of position, dimension, and shape. When the bracket 90 is assembled to the cartridge body 31, the hole 96 is positioned frontward of a protruding end of the ink supply portion 34 in the front-rear direction (depthwise direction 53) as will be described later.

The front wall 140 is also formed with a hole 97 at a position below the through-hole 95 with respect to the height direction 52. The hole 97 penetrates the front wall 140 in the depthwise direction 53. When the bracket 90 is assembled to the cartridge body 31, the ink supply portion 34 of the inner frame 35 is exposed outside through the hole 97. Thus, the hole 97 is formed so as to correspond to the ink supply portion 34 of the inner frame 35 in terms of position, dimension, and shape. The hole 97 is positioned rearward of the hole 96 in the front-rear direction (the depthwise direction 53).

The front wall 140 is provided with a first protrusion 85 and a second protrusion 86. As shown in FIGS. 2 to 4, the first protrusion 85 is formed at an upper end portion of the front wall 140 so as to protrude therefrom in a direction away from the front wall 140 (i.e., frontward, or in the loading direction 56). The hole 96 is formed on a protruding end of the first protrusion 85. The second protrusion 86 is formed at a lower end portion of the front wall 140 so as to protrude therefrom in a direction away from the front wall 140 (i.e., frontward, or in the loading direction 56). That is, the hole 97 is positioned between the through-hole 95 and the second protrusion 86 with respect to the height direction 52. The first and second protrusions 85 and 86 are detected by a sensor (not shown) provided in the cartridge accommodating section 110 so as to allow the printer 10 to determine a type of the mounted ink cartridge 30. The type of the ink cartridge 30 can be discriminated based on differences in ink color, ink component, or initial amount of ink stored in the ink chamber 36.

(3-3) Inner Frame

As shown in FIGS. 3 and 4, the inner frame 35 is formed in an annular shape in which a pair of surfaces opposed to each other in the widthwise direction 51 are open. Each of the opened surfaces is sealed by a film (not illustrated) to form the ink chamber 36 in the inner frame 35 for storing ink.

The inner frame 35 has a front wall 40 serving to define the ink chamber 36. The front wall 40 opposes the front wall 140 of the bracket 90 in the depthwise direction 53 when the inner frame 35 is inserted in the bracket 90. The inner frame 35 is provided with the detection portion 33, the ink supply portion 34, the air communication portion 120 and a block-member accommodating chamber 32.

The detecting portion 33 protrudes frontward (in the loading direction 56) from the front wall 40 at a generally intermediate position in the height direction 52. The detecting portion 33 has a box-like shape whose one end is open so as to allow the ink in the ink chamber 36 to be in fluid communication with the detecting portion 33 via the open end. The detecting portion 33 is exposed outside of the bracket 90 through the through-hole 95 when the bracket 90 is assembled to the cartridge body 31. The detecting portion 33 has a pair of side walls made from a light transmissive resin. In the present embodiment, these side walls are configured to allow the light emitted from the optical sensor 114 (FIG. 1) to pass therethrough in the direction perpendicular to the loading/unloading direction 50 (i.e., the widthwise direction 51 or horizontal direction). The light may be infrared light or visible light.

As shown in FIG. 4, the detecting portion 33 provides therein a hollow space between the pair of side walls such that ink can be present therebetween. Within this hollow space, an indicator 62 of a sensor arm 60 is movably positioned.

The sensor arm 60 is movably provided in the ink chamber 36. The sensor arm 60 includes an arm body 61 and a pivot shaft 64. The arm body 61 is plate-like shaped, and is pivotally movably supported to the pivot shaft 64. The pivot shaft 64 extends in the widthwise direction 51 and is supported to the inner frame 35. The arm body 61 has one free end provided with the indicator 62 movably positioned in the hollow space of the detecting portion 33, and another free end provided with a float 63 dipped in the ink. With this structure, the sensor arm 60 is adapted to change its pivoting posture in accordance with an amount of the ink in the ink chamber 36 between a lower position in which the indicator 62 approaches a lower wall of the detecting portion 33 and an upper position in which the indicator 62 approaches an upper wall of the detecting portion 33.

With this structure, when the ink cartridge 30 is mounted in the cartridge accommodating section 110, the detecting portion 33 can change its light transmission state between a transmissive state and a non-transmissive state. In the transmissive state, not less than a predetermined amount of infrared light from the optical sensor 114 can be transmitted through the detecting portion 33, and in the non-transmissive state, less than the predetermined amount of infrared light is transmitted therethrough (i.e., the light may be shut off or attenuated). More specifically, the transmissive state and non-transmissive state are provided when the indicator 62 is at its upper position and lower position, respectively. In accordance with the light transmission state at the detecting portion 33, whether the amount of ink in the ink chamber 36 is less than the prescribed amount can be detected.

As shown in FIGS. 2 to 3, the ink supply portion 34 is provided at the front wall 40 below the detecting portion 33. The ink supply portion 34 has a hollow cylindrical shape protruding from the front wall 40 in the loading direction 56, i.e., frontward in the front-rear direction. The ink supply portion 34 is exposed outside through the hole 97 formed in the bracket 90 when the ink cartridge 30 is assembled.

The ink supply portion 34 has a protruding end in which the ink supply outlet 71 is formed. As shown in FIG. 1, the ink passage 72 is formed inside the ink supply portion 34. The ink passage 72 extends in the depthwise direction 53 and is configured to establish communication between the ink supply outlet 71 and the ink chamber 36. The ink supply valve 70 is disposed in the ink passage 72 to open and close the ink supply outlet 71.

Upon loading the ink cartridge 30 into the cartridge accommodating section 110, the ink needle 113 is inserted into the ink supply outlet 71. The ink needle 113 thus moves the ink supply valve 70 rearward in the front-rear direction to open the ink supply outlet 71. Thus, the ink in the ink chamber 36 is permitted to flow into the ink needle 113 via the ink passage 72. In the present embodiment, the ink flows out in a direction generally coincident with the loading direction 56 (or frontward in the front-rear direction).

Instead of the ink supply valve 70, a film covering the ink supply outlet 71 is available. In the latter case, upon loading the ink cartridge 30 into the cartridge accommodating section 110, the ink needle 113 breaks the film to open the ink supply outlet 71.

As illustrated in FIGS. 3 and 4, a pair of engagement claws 43 is formed at a lower end portion of the front wall 40 of the inner frame 35. Each engagement claw 43 has a distal end portion that protrudes outward in the widthwise direction 51. The engagement claws 43 define a distance therebetween in the widthwise direction 51 such that the engagement claws 43 can resiliently deform inward in the widthwise direction 51. Upon assembly of the bracket 90 to the cartridge body 31 and the inner frame 35, the distal end portions of the engagement claws 43 respectively enter the pair of elongated holes 91 formed in the bracket 90 and engage inner peripheral surfaces of cylindrical inner walls constituting the elongated holes 91.

The inner frame 35 has an upper wall in which the engaging portion 45 is formed. The engaging portion 45 includes the engaging surface 46 extending in the widthwise direction 51 and the height direction 52. The engaging surface 46 is configured to engage the engaging member 145 of the cartridge accommodating section 110 when the ink cartridge 30 is loaded in the cartridge accommodating section 110. When engaged with the engaging member 145, the engaging portion 45 (engaging surface 46) is adapted to receive the biasing force acting in the unloading direction 55.

The air communication portion 120 is formed on the front wall 40 above the detection portion 33 in the height direction 52 so as to protrude from the front wall 40 in the loading direction 56. The air communication portion 120 is configured to allow the ink chamber to be in communication with outside of the ink cartridge 30.

Figures 5A, 5B:
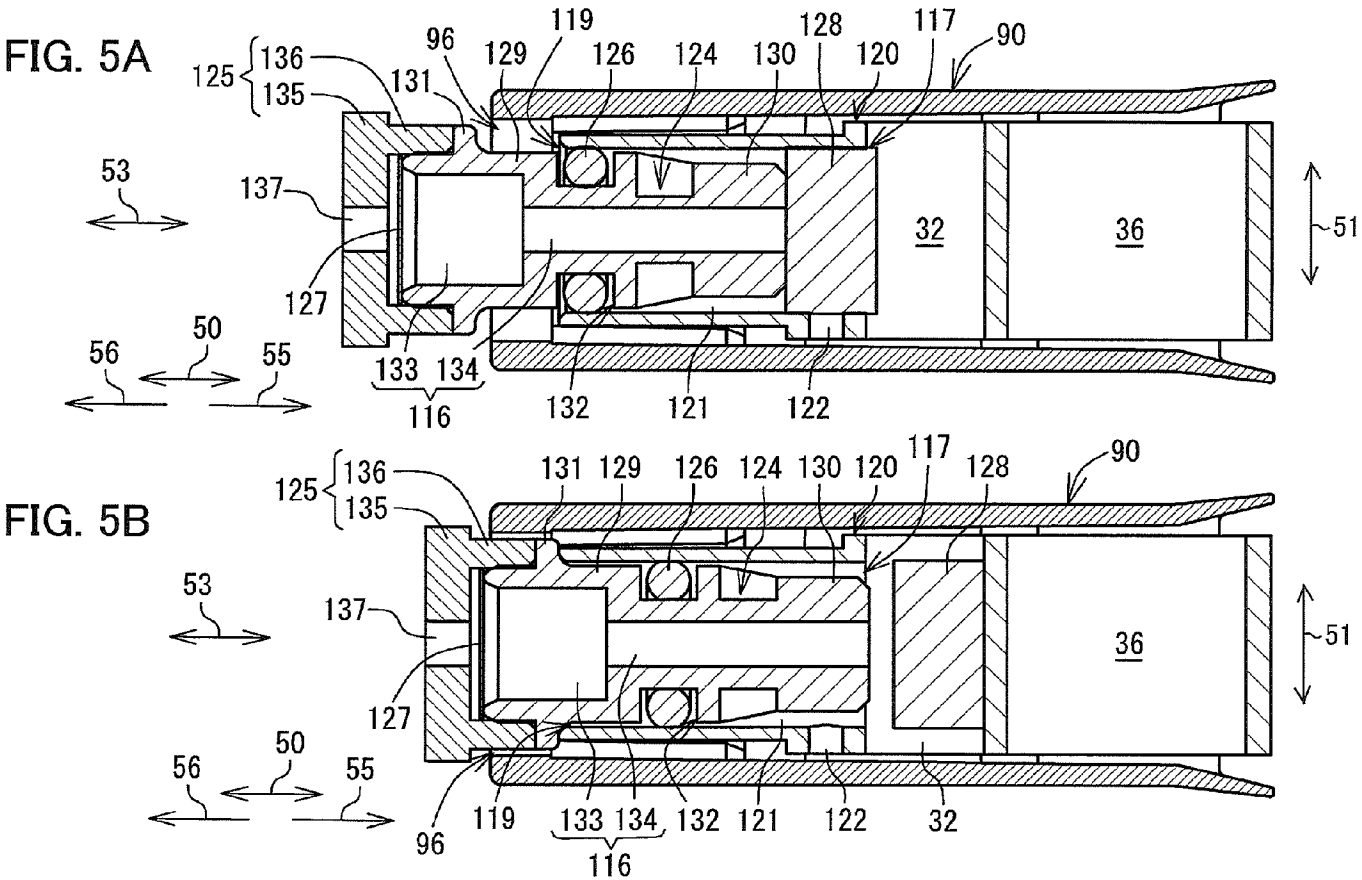
FIG. 5A is a horizontal cross-sectional view of the air communication portion according to the first embodiment when viewed from above, wherein an air passage formed in the air communication portion is closed.
FIG. 5B is a horizontal cross-sectional view of the air communication portion according to the first embodiment when viewed from above, wherein the air passage formed in the air communication portion is opened.
Figure 6:
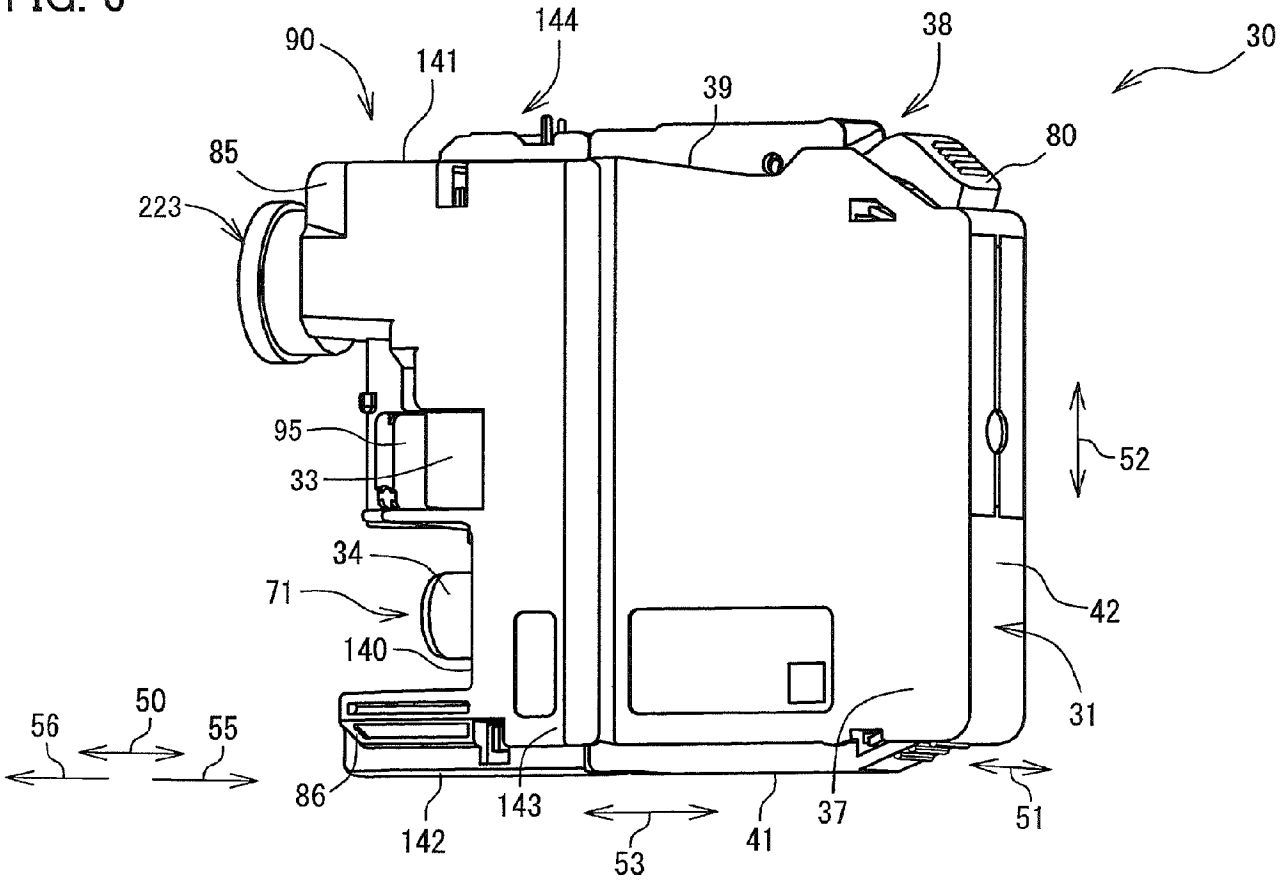
FIG. 6 is a perspective view showing an external appearance of an ink cartridge according to a second embodiment of the present invention.
Figure 7:
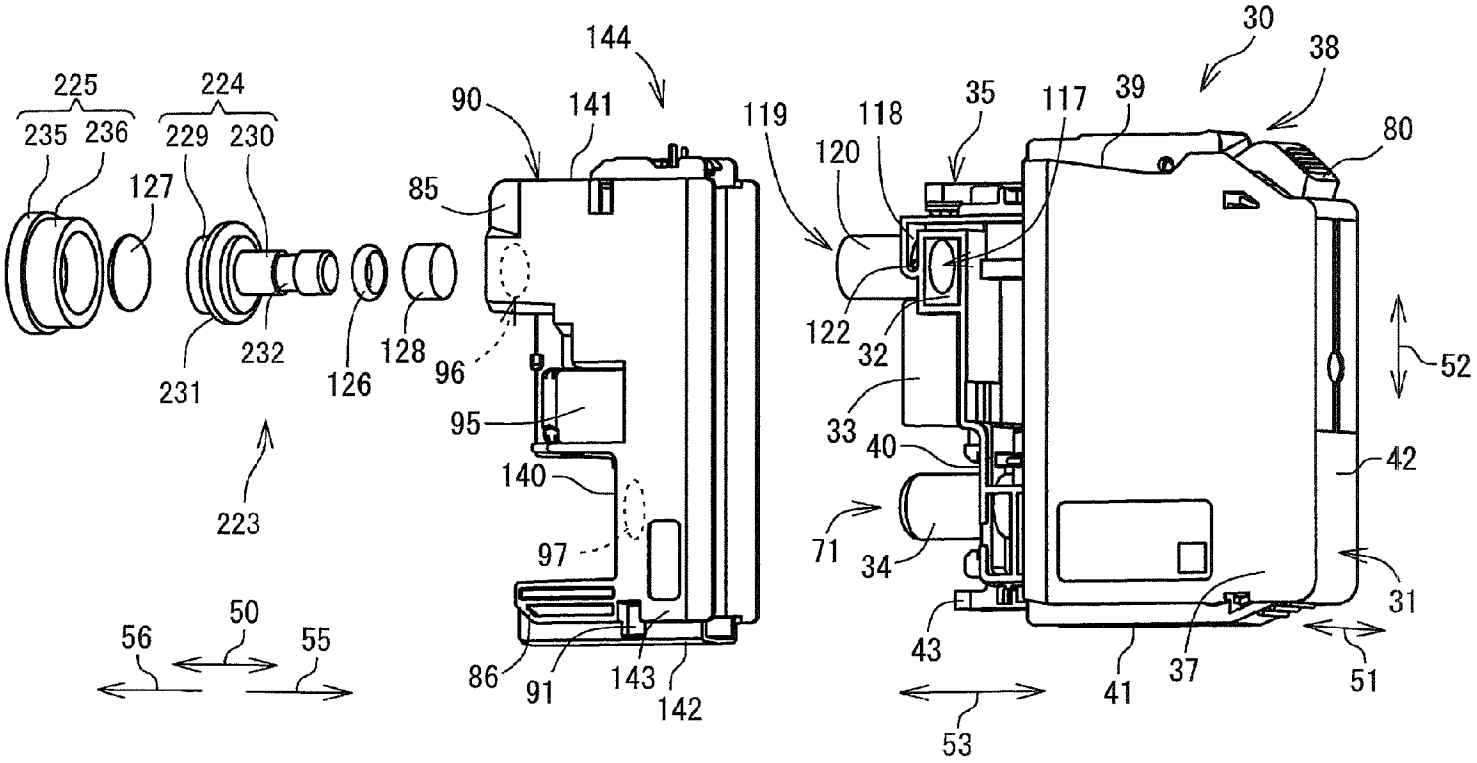
FIG. 7 is an exploded perspective view showing the external appearance of the ink cartridge according to the second embodiment, the ink cartridge including a cartridge body, an inner frame housed in the cartridge body and a bracket assembled to the cartridge body.
Figure 8:
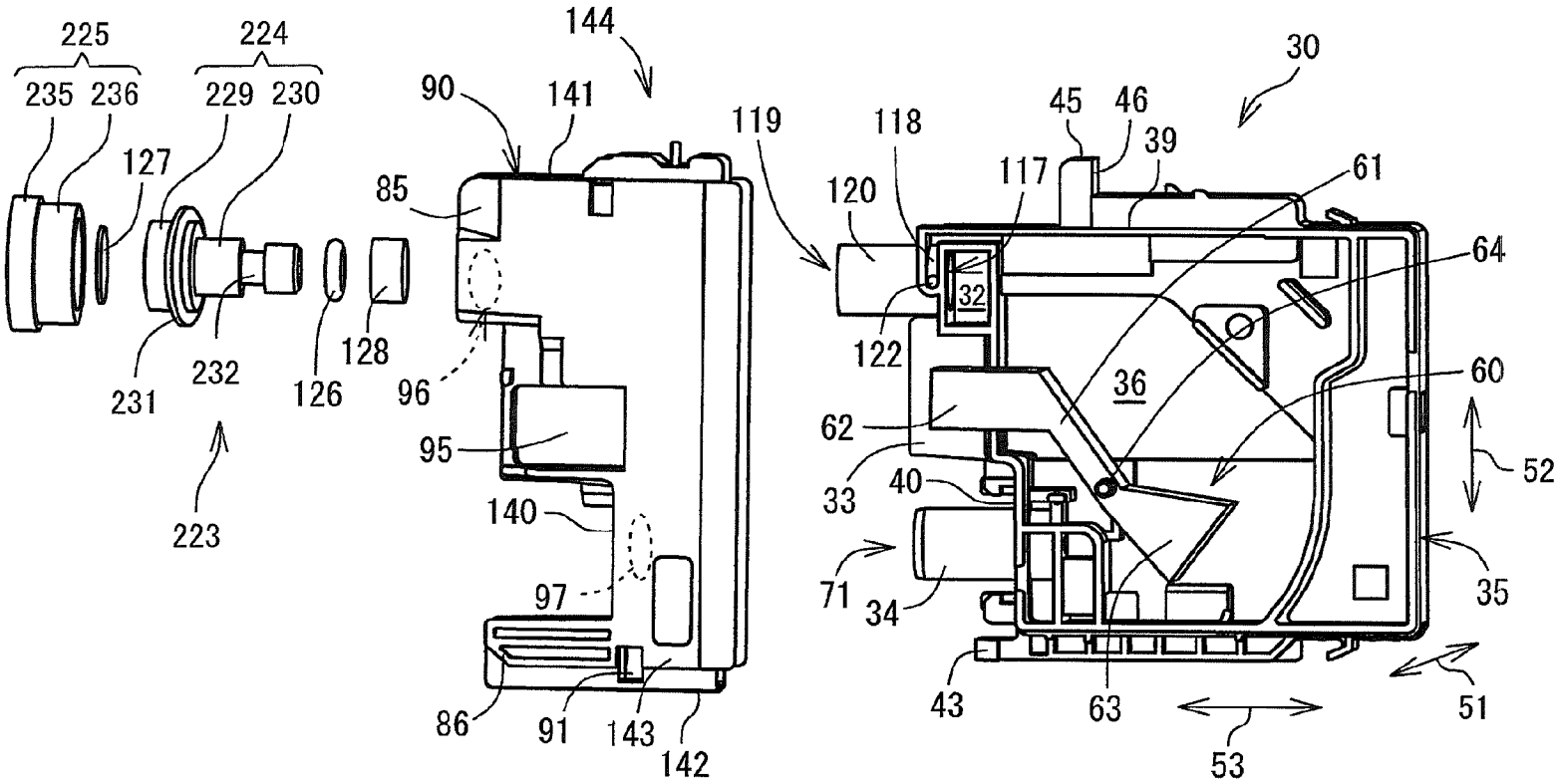
FIG. 8 is an exploded side view of the ink cartridge according to the second embodiment, wherein the inner frame is exposed to show an air communication portion according to the second embodiment.

The air communication portion 120 is hollow, generally cylindrical shaped and has a protruding end in which the aperture 119 is formed. As shown in FIGS. 5A and 5B, the air communication portion 120 has a generally tubular-shaped inner peripheral wall that defines an internal space serving as an air passage 121. The air passage 121 is in communication with the aperture 119 and extends in the depthwise direction 53. The air passage 121 has a diameter substantially the same as the diameter of the aperture 119 and smaller than the diameter of the hole 96 formed in the bracket 90. A communication port 122 is formed on the inner peripheral wall defining the air passage 121. The communication port 122 penetrates the inner peripheral wall in the widthwise direction 51.

The air communication portion 120 is formed with an opening 117 on a side opposite to the aperture 119 with respect to the air passage 121 in the depthwise direction 53. The opening 117 has a diameter the same as that of the air passage 121 and is in communication therewith. The communication port 122 formed on the inner peripheral wall is positioned adjacent to the opening 117 and functions to allow fluid communication between the air passage 121 and the ink chamber 36.

The block-member accommodating chamber 32 is formed rearward of the air passage 121 in the front-rear direction (depthwise direction 53) and in communication therewith. Thus, the air passage 121 and the block-member accommodating chamber 32 are in fluid communication with each other via the opening 117. The block-member accommodating chamber 32 is a closed space except the opening 117 and has a cross-sectional area larger than that of the air passage 121 when taken along a plane extending the widthwise direction 51 and height direction 52. In other words, the block-member accommodating chamber 32 has a larger cross section than the air passage 121 when viewed in the depthwise direction 53, as shown in FIGS. 5A and 5B.

Preferably, the cross-sectional area of the block-member housing chamber 32 is larger than the cross-sectional area of the opening 117 formed at the rear edge of the air passage 121.

As shown in FIG. 4, a communicating groove 118 is formed in an upper-front end portion of the inner frame 35 and is defined by walls and the film constituting the inner frame 35. The communicating groove 118 has a generally L shape. Specifically, the communicating groove 118 has one end in communication with the ink chamber 36, extending forward from the one end communicating with the ink chamber 36 and then extending downward along the air communication portion 120 to have a lower end at which the communication port 122 is formed. The downwardly-extending portion of the communicating groove 118 overlaps with the air communication portion 120 in the widthwise direction 51. The communication port 122 is positioned above an initial position (i.e., topmost position) of a liquid surface of the ink stored in the ink chamber 36 in the height direction 52. Thus, air introduced into the air passage 121 through the aperture 119 flows into the communicating groove 118 through the communication port 122, and finally flows into the ink chamber 36.

Within the air passage 121 of the air communication portion 120, a slider 123 and the block member 128 are disposed, as shown in FIG. 5A. Note that FIG. 5A shows a state where the ink cartridge 30 is unused.

In the present embodiment, the block member 128 is initially disposed in the air passage 121 such that the block member 128 closes the air passage 121 between the aperture 119 and the communication port 122 for blocking air flow, as shown in FIG. 5A. The block member 128 has a substantially columnar shape and is made of an elastic member such as a rubber. The block member 128 has an outer diameter slightly larger than the diameter of the air passage 121. The block member 128 is in close contact with the inner peripheral wall defining the air passage 121 such that the outer peripheral surface of the block member 128 covers the communication port 122 completely. This position of the block member 128 in FIG. 5A will be referred to as a first position, hereinafter.

The block member 128 at the first position is disposed to fully cover the communication port 122 in the present embodiment, but the communication port 122 may not necessarily be fully covered by the block member 128 at the first position. For example, the block member 128 at the first position may be positioned in the air passage 121 somewhere between the aperture 119 and the communication port 122 (downstream of the aperture 119 but upstream of the communication port 122 in the unloading direction 55), provided that the block member 128 is in close contact with the inner peripheral wall of the air communication portion 120 to close the air passage 121. In this example, the communication port 122 is not covered by the block member 128, but the air flow is blocked by the block member 128 at the first position due to the close contact of the block member 128 with the inner peripheral wall.

The slider 123 is slidably disposed in the air passage 121 at a position closer to the aperture 119 than the block member 128 at the first position to the aperture 119. When the inner frame 35 is assembled to the bracket 90, one end of the slider 123 is exposed outside through the hole 96, as shown in FIG. 2.

The slider 123 is disposed to be tightly fitted with the inner peripheral wall defining the air passage 121. Specifically, the slider 123 includes a generally cylindrical-shaped slider main body 124, a cap 125, an O-ring 126 and a semipermeable membrane 127.

The slider main body 124 extends in the depthwise direction 53 and is configured to slide in a sliding direction coincident with the unloading direction 55 (or the depthwise direction 53). As illustrated in FIGS. 5A and 5B, a through-hole 116 is formed inside the slider main body 124 to penetrate the same in the sliding direction (i.e., depthwise direction 53, or a direction coincident with the direction in which the air communication portion 120 extends).

The slider main body 124 has a generally cylindrical shape and includes a large-diameter portion 129 and a small-diameter portion 130. The large-diameter portion 129 has an outer diameter larger than that of the small-diameter portion 130. The slider main body 124 is disposed inside the air passage 121 in such an orientation that the large-diameter portion 129 is positioned upstream of the small-diameter portion 130 in the sliding direction.

The large-diameter portion 129 has an upstream end portion exposed outside of the ink cartridge 30. The large-diameter portion 129 has an outer peripheral surface on which a disk-shaped flange portion 131 is formed midway in the sliding direction. The flange portion 131 protrudes radially outward from the outer peripheral surface of the large-diameter portion 129. The flange portion 131 has an outer diameter larger than the inner diameter of the air communication portion 120 (diameter of the air passage 121). The small-diameter portion 130 has an outer peripheral surface in which a circumferential groove 132 is formed for retaining the O-ring 126.

As illustrated in FIGS. 5A and 5B, the through-hole 116 penetrating the slider main body 124 is configured of a large-diameter hole 133 and a small-diameter hole 134. The large-diameter hole 133 is formed in the large-diameter portion 129 to coaxially penetrate the same in the sliding direction, and the small-diameter hole 134 is formed in the small-diameter portion 130 to coaxially penetrate the same in the sliding direction. That is, the small-diameter hole 134 is formed upstream of the large-diameter hole 133 in the sliding direction so as to be in communication therewith. The large-diameter hole 133 is open on the upstream end portion of the large-diameter portion 129. The upstream end portion of the large-diameter portion 129 is covered, from its front side, by the semipermeable membrane 127 to seal the large-diameter hole 133. The small-diameter hole 134 is open on a downstream end portion of the small-diameter portion 130 in the sliding direction. The small-diameter hole 134 has a cross-sectional area smaller than a cross-sectional area of the large-diameter hole 133 when viewed in the sliding direction (i.e., in the widthwise direction 51).

The cap 125 is coupled to the large-diameter portion 129 of the slider main body 124 such that the cap 125 covers the semipermeable membrane 127 attached to the upstream end portion of the large-diameter portion 129. The cap 125 of the first embodiment includes a lid portion 135 and a cylinder portion 136. The lid portion 135 has a generally disk-like shape with a thickness in the depthwise direction 53 and has an inner surface (downstream surface) from which the cylinder portion 136 protrudes downstream in the sliding direction. The lid portion 135 is formed with a through-hole 137 that coaxially penetrates the lid portion 135 in the sliding direction. The lid portion 135 has an outer diameter larger than the diameter of the hole 96 formed in the bracket 90. The cylinder portion 136 is formed to coaxially surround the through-hole 137.

The through-hole 116 (large-diameter hole 133 and small-diameter hole 134) penetrating the slider main body 124 and the through-hole 137 formed in the cap 125 are in alignment with and in communication with each other in the sliding direction to constitute a single communication hole in the slider 123. In other words, this single communication hole is opened on its upstream and downstream ends of the slider 123 in the sliding direction. Put another way, the slider 123 is formed with the single through-hole that penetrates therethrough in the sliding direction.

The cylinder portion 136 of the cap 125 covers an outer peripheral surface of the upstream end portion of the large-diameter portion 129. The cylinder portion 136 has an inner diameter slightly smaller than the outer diameter of the large-diameter portion 129. Hence, the cap 125 is press-fitted to the large-diameter portion 129 of the slider main body 124. The cylinder portion 136 has such a length in the sliding direction that a protruding end (downstream end) of the cylinder portion 136 is brought into contact with the flange portion 131 before the inner surface of the lid portion 135 abuts on the semipermeable membrane 127 during a process where the cap 125 is attached to the large-diameter portion 129. In other words, as illustrated in FIGS. 5A and 5B, when the cap 125 has been coupled to the slider main body 124, the inner surface of the lid portion 135 and the semipermeable membrane 127 are separated from each other to define a gap therebetween.

The O-ring 126 is mounted and received in the circumferential groove 132 formed in the outer peripheral surface of the small-diameter portion 130 of the slider main body 124. The O-ring 126 has a ring-like shape and is formed of an elastic member such as a rubber. When fitted to the circumferential groove 132, the O-ring 126 has an outer diameter larger than the inner diameter of the air communication portion 120. That is, in a state where the slider 123 is inserted in the air passage 121, the O-ring 126 is in tight contact with the inner peripheral wall of the air communication portion 120.

On the other hand, the outer diameters of the large-diameter portion 129 and small-diameter portion 130 are smaller than the inner diameter of the air communication portion 120 (the diameter of the air passage 121). Hence, when the slider 123 slides along the air passage 121, only the O-ring 126 is always in sliding contact with the inner peripheral wall of the air communication portion 120. Further, since the outer diameter of the flange portion 131 is larger than the inner diameter of the air communication portion 120, the flange portion 131 abuts on the protruding end of the air communication portion 120 (the end defining the aperture 119) when the slider 123 slides along the air passage 121 in the sliding direction. This abutment of the flange portion 131 with the protruding end of the air communication portion 120 restricts further sliding of the slider 123 in the sliding direction.

The semipermeable membrane 127 is attached to the upstream end portion of the large-diameter portion 129 to seal the large-diameter hole 133. The semipermeable membrane 127 is made of a porous membrane having minute holes and is configured to allow passage of air but restrict passage of liquid (i.e., ink in the present embodiment). For example, the semipermeable membrane 127 may be made of a fluorine resin, such as polytetrafluoroethylene, polychlorotrifluoroethylene, tetrafluoroethylene-hexafluoropropylen copolymer, tetrafluoro ethylene-perfluoroalkylvinylether copolymer, and tetrafluoroethylene-ethylene copolymer.

The slider 123 with the above-configuration is configured to slide in and along the air passage 121 in the sliding direction. In an initial state (before the ink cartridge 30 is used), the slider 123 is in abutment with the block member 128, as shown in FIG. 5A. As the slider 123 is being pushed in the sliding direction, the block member 128 is also moved in the sliding direction by the slider 123 to open the communication port 122. Finally, as illustrated in FIG. 5B, the block member 128 pushed by the slider 123 is moved in the sliding direction to fall inside the block-member accommodating chamber 32. This position of the block member 128 illustrated in FIG. 5B will be referred to as a second position, hereinafter.

When the block member 128 is at the second position, the communication port 122 is fully opened as shown in FIG. 5B in the present embodiment. However, the communication port 122 may not necessarily be fully exposed, but may be partially covered by the block member 128 at the second position. For example, the second position of the block member 128 may be defined as such a position that the outer peripheral surface of the block member 128 partially overlaps with the communication port 122 as the block member 128 is pushed to move in the sliding direction.

Before the ink cartridge 30 is used, the ink chamber 36 is maintained at a negative pressure and the air communication portion 120 is in a closed state, as illustrated in FIG. 5A. In the unused ink cartridge 30, the downstream end of the slider 123 (the downstream end portion of the small-diameter portion 130) is in abutment with the block member 128 at the first position. In other words, the small-diameter hole 134 is closed by the block member 128 at the first position. The block member 128 at the first position also seals (closes) the communication port 122 in the present embodiment. Accordingly, the ink chamber 36 is closed off from ambient air. This configuration is effective in preventing the ink stored in the ink chamber 36 from leaking outside.

Upon use of the ink cartridge 30, the slider 123 is caused to slide in the sliding direction from the initial state shown in FIG. 5A. More specifically, the slider 123 is applied with a pressing force acting in the sliding direction (unloading direction 55), through the cap 125, from the user or from the cartridge accommodating section 110, causing the slider 123 to slide in the sliding direction.

While the slider 123 is sliding in the sliding direction, the slider 123 receives a sliding resistance through the O-ring 126 due to the sliding contact of the O-ring 126 with the inner peripheral wall defining the air passage 121. At the same time, the slider 123 also receives a reactive force from the block member 128 acting in a direction opposite to the sliding direction due to an elastic force of the block member 128. That is, the slider 123 is configured to slide in the sliding direction against the sliding resistance of the O-ring 126 and the reactive force from the block member 128. Incidentally, friction force resulting from the sliding contact between the O-ring 126 and the inner peripheral wall is large enough to resist the reactive force applied to the slider 123 from the block member 128. Hence, the slider 123 is prevented from moving back in the direction opposite to the sliding direction once the slider 123 starts to slide in the sliding direction. In this aspect, sliding movement of the slider 123 is irreversible in the sliding direction.

As the block member 128 is moved in the sliding direction in accordance with sliding of the slider 123, the communication port 122 is gradually exposed. However, as long as the downstream end of the slider 123 and the block member 128 are in contact with each other, the small-diameter hole 134 is closed by the block member 128. Therefore the ink chamber 36 is prevented from communicating with ambient air. Hence, the ink chamber 36 is maintained at the negative pressure.

As the slider 123 is further moved toward the second position, the block member 128 passes through the air passage 121 and finally falls into the block-member accommodating chamber 32 at a certain moment before the block member 128 reaches the second position at which the block member 128 has been accommodated in the block-member accommodating chamber 32, as show in FIG. 5B.

The flange portion 131 and the protruding end of the air communication portion 120 are spaced apart from each other by a distance that is larger than a distance by which the block member 128 is designed to move from the first position to until the moment the block member 128 falls into the block-member accommodating chamber 32. Therefore, the flange portion 131 is still separated from the protruding end of the air communication portion 120 at the very moment when the block member 128 actually falls into the block-member accommodating chamber 32. This means that, the slider 123 can still move further downstream in the sliding direction until the flange portion 131 contacts the protruding end of the air communication portion 120, even after the block member 128 has already been accommodated in the block-member accommodating chamber 32.

Incidentally, the slider 123 receives a load from the block member 128 while the block member 128 moves along the air passage 121, but the load is no longer applied to the slider 123 once the block member 128 has passed the air passage 121 and fallen into the block-member accommodating chamber 32. Due to this change (reduction) in resistance applied to the slider 123, the user can recognize that the block member 128 has been accommodated in the block-member accommodating chamber 32 and that the ink chamber 36 has communicated with ambient air. The above-depicted structure is therefore particularly effective in a case where the user moves the slider 123.

When the slider 123 is fully slid in the sliding direction and is restricted from being slid further due to the abutment of the flange portion 131 with the protruding end of the air communication portion 120, the block member 128 has passed through the air passage 121 and been received in the block-member accommodating chamber 32 through the opening 117, thereby enabling the small-diameter hole 134 to be in communication with the air passage 121, as illustrated in FIG. 5B. In this state, the O-ring 126 is positioned upstream of the communication port 122, while the downstream end portion of the small-diameter portion 130 (on which the small-diameter hole 134 is opened) is positioned downstream of the communication port 122 in the sliding direction. Hence, air flowing into the large-diameter hole 133 through the through-hole 137 of the lid portion 135 passes through the small-diameter hole 134, flows into the air passage 121 via the small-diameter hole 134, follows an outer peripheral surface of the slider 123, and finally flows into the ink chamber 36 through the communication port 122. As a result, pressure within the ink chamber 36 is brought into atmospheric pressure. In the state of FIG. 5B, the air passage 121 is mostly closed by the slider 123 and communicates with ambient air only through the through-hole formed inside the slider 123 (i.e., via the through-holes 116 and 137). Therefore, the through-hole penetrating the slider 123 can be considered as a part of the air passage 121.

4. Operational and Technical Advantages

The slider 123 of the first embodiment is not connected to the block member 128 but only abuts against the block member 128. Hence, the slider 123 cannot move the block member 128 in the direction opposite to the sliding direction (i.e., loading direction 56). Moreover, since the outer diameter of the block member 128 is larger than the diameter of the air passage 121 (at least larger than the diameter of the opening 117 (downstream edge the air passage 121 in the sliding direction)), it is quite difficult to bring the block member 128, which has once fallen into the block-member accommodating chamber 32, back into the air passage 121. In this sense as well, the block member 128 of the first embodiment is configured to move in an irreversible manner from the first position to second position (i.e., in the sliding direction) within the air passage 121.

In this way, according to the air communication portion 120 of the first embodiment, the block member 128 for closing the communication port 122 is allowed to move only in the sliding direction. With such simple structure, communication between the ink chamber 36 and ambient air can be realized.

Incidentally, the slider 123 may be slid by the user prior to use, or may be configured to be slid automatically upon attachment of the ink cartridge 30 to the printer 10. For example, in the latter case, a rod may be provided to protrude from the end wall of the cartridge accommodating section 110 at a position corresponding to the position of the air communication portion 120. With this configuration, the rod abuts on the slider 123 when the ink cartridge 30 is being mounted in the cartridge accommodating section 110, thereby causing the 123 to slide in the sliding direction.

Further, as the block member 128 is pushed toward the block-member accommodating chamber 32, contact area between the block member 128 and the inner peripheral wall of the air communication portion 120 is gradually reduced. This allows the load required to slide the slider 123 in the sliding direction to be gradually reduced. Moreover, the load required to slide the slider 123 abruptly drops when the block member 128 is fully accommodated in the block-member accommodating chamber 32. As a result, especially in a case where the user slides the slider 123, he or she can reliably recognize that the ink chamber 36 communicates with the ambient air due to the change (reduction) of the load.

Further, in the slider 123 of the depicted embodiment, only the O-ring 126 is in tight contact with the inner peripheral wall of the air communication portion 120, while the large-diameter portion 129 and the small diameter portion 130 are not tightly fitted to the inner peripheral wall of the air communication portion 120. This construction enables the sliding resistance acting on the slider 123 to be reduced, since tight contact of the slider 123 with the inner peripheral wall of the air communication portion 120 only occurs at a limited area (i.e., at the O-ring 126 only), and since the outer diameter of the slider main body 124, especially the outer diameter of a portion of the slider main body 124 positioned downstream of the O-ring 126 in the sliding direction, is smaller than the inner diameter of the air communication portion 120.

Further, in the state shown in FIG. 5B where the ink chamber 36 communicates with ambient air, the O-ring 126 is positioned upstream of the communication port 122 in the sliding direction. Hence, even if the ink stored in the ink chamber 36 accidentally flows into the air passage 121 via the communication port 122, such ink is blocked by the O-ring 126. Moreover, since the downstream end portion of the small-diameter portion 130 is positioned downstream of the communication port 122 in the sliding direction at this time (i.e., the small-diameter hole 134 is open toward downstream at a position downstream of the communication port 122), ink flowing into the air passage 121 cannot enter inside the through-hole 116 of the slider 123 unless the ink once flows into the block-member accommodating chamber 32.

Further, assuming that leaked ink flows out along a path generally extending in the direction opposite to the sliding direction, the large-diameter hole 133 is disposed downstream of the small-diameter hole 134 in the assumed ink out-flow path. Hence, an ink meniscus is formed at the boundary between the small-diameter hole 134 and large-diameter hole 133 within the slider 123 in case that ink leakage occurs. This meniscus can suppress the ink entering into the through-hole 116 from reaching the semipermeable membrane 127. Further, even if the ink indeed reaches the semipermeable membrane 127 through the through-hole 116, the semipermeable membrane 127 can prevent the ink from leaking outside of the air communication portion 120. Thus, this configuration can effectively suppress the ink from flowing out of the air communication portion 120.

Moreover, since the semipermeable membrane 127 is provided at the most downstream in the assumed ink out-flow path, an amount of ink that possibly reaches the semipermeable membrane 127 can be reduced extremely low. At the same time, such reduction in the amount of ink possibly adhered to the semipermeable membrane 127 can suppress degradation in air permeability of the semipermeable membrane 127.

Further, in the air communication portion 120 according to the first embodiment, the semipermeable membrane 127 is attached to the upstream end portion of the large-diameter portion 129 to seal the large-diameter hole 133 and the cap 125 is coupled to the slider main body 124 with a gap defined between the lid portion 135 and the semipermeable membrane 127. With this configuration, space is ensured on both sides of the semipermeable membrane 127 in the sliding direction so that air can smoothly pass through the semipermeable membrane 127.

Further, provision of the slider 123 inside the air communication portion 120 (i.e., in the air passage 121) as in the present embodiment eliminates the need to additionally allocate a space for sliding the slider 123 outside of the air communication portion 120. This structure contributes to a reduction in size of the ink cartridge 30 or an increase in capacity of the ink cartridge 30.

Second Embodiment

A slider 223 according to a second embodiment of the present invention will then be described with reference to FIGS. 6 to 9B, wherein like parts and components will be assigned with the same reference numerals as those of the first embodiment to avoid duplicating explanation.

The slider 223 of the second embodiment includes a slider main body 224, a cap 225 attached to the slider main body 224, the semipermeable membrane 127 and the O-ring 126.

The slider main body 224 includes a large-diameter portion 229 and a small-diameter portion 230. The slider main body 224 is disposed in the air passage 121 in such an orientation that the large-diameter portion 229 is positioned upstream of the small-diameter portion 230 in the sliding direction.

The large-diameter portion 229 is formed with a large-diameter hole 233 that penetrates through the large-diameter portion 229 in the sliding direction, as in the first embodiment. However, the small-diameter portion 230 of the second embodiment has two kinds of holes formed inside, instead of a single hole (i.e., small-diameter hole 134 in the first embodiment). More specifically, the small-diameter portion 230 is formed with a middle-diameter hole 234*a* and a small-diameter hole 234*b* to be in communication with each other. The middle-diameter hole 234*a* is positioned upstream of the small-diameter hole 234*b* in the sliding direction and in communication therewith.

The large-diameter hole 233 is open on an upstream end portion of the large-diameter portion 229 in the sliding direction. The semipermeable membrane 127 is provided at the upstream end portion of the large-diameter portion 229 to seal the large-diameter hole 233. The large-diameter hole 233 is positioned upstream of the middle-diameter hole 234*a* in the sliding direction to be in fluid communication therewith. The small-diameter hole 234*b* is open on a downstream end portion of the small-diameter portion 130. The large-diameter hole 233, middle-diameter hole 234*a*, small-diameter hole 234*b* are aligned in this order in the sliding direction and coaxially (concentrically) positioned formed inside the slider main body 224. Put another way, the large-diameter hole 233, middle-diameter hole 234*a* and small-diameter hole 234*b* constitute a single through-hole 216 that penetrates the slider main body 224 in the sliding direction.

The large-diameter hole 233 has a length (depth) smaller than each of those of the middle-diameter hole 234*a* and small-diameter hole 234*b* in the sliding direction. The middle-diameter hole 234*a* has a cross-sectional area smaller than that of the large-diameter hole 233 when viewed in the sliding direction (i.e., in the widthwise direction 51). The small-diameter hole 234*b* has a cross-sectional area smaller than that of the small-diameter hole 234*b* when viewed in the sliding direction (i.e., in the widthwise direction 51). In other words, the through-hole 216 has its diameter increased in a stepwise manner toward upstream in the sliding direction.

The large-diameter portion 229 has an outer peripheral surface on which a flange portion 231 is formed midway in the sliding direction to protrude radially outward from the outer peripheral surface.

As in the first embodiment, the cap 225 is fitted to the large-diameter portion 229 of the slider main body 224 such that the cap 125 covers the semipermeable membrane 127 attached to the upstream end portion of the large-diameter portion 229. The cap 225 includes a lid portion 235 and a cylinder portion 236. The lid portion 235 is formed with a through-hole 237 that coaxially penetrates therethrough in the sliding direction. The lid portion 235 has an outer diameter that is larger than the diameter of the hole 96 formed in the bracket 90. The cylinder portion 236 is formed to protrude downstream from an inner surface (downstream surface) of the lid portion 235 such that the cylinder portion 236 is coaxially positioned with the through-hole 237. The cylinder portion 236 has a protruding end (downstream end) that is brought into abutment with the flange portion 231 to provide a gap between the semipermeable membrane 127 and the inner surface of the lid portion 235 when the cap 225 is attached to the slider main body 224, as in the first embodiment.

Figure 9A:
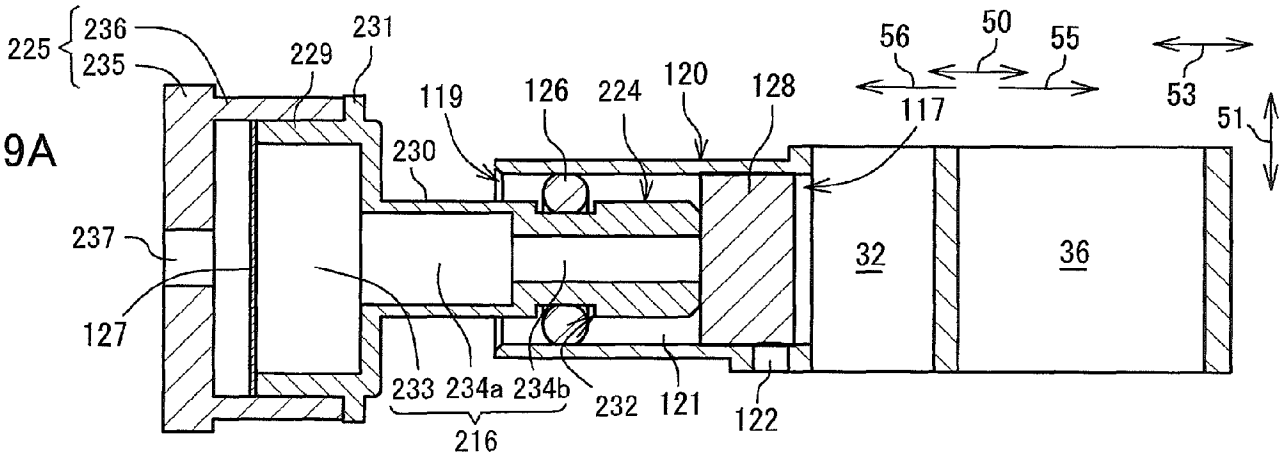
FIG. 9A is a horizontal cross-sectional view of the air communication portion according to the second embodiment when viewed from above, wherein an air passage formed in the air communication portion is closed.
Figure 9B:
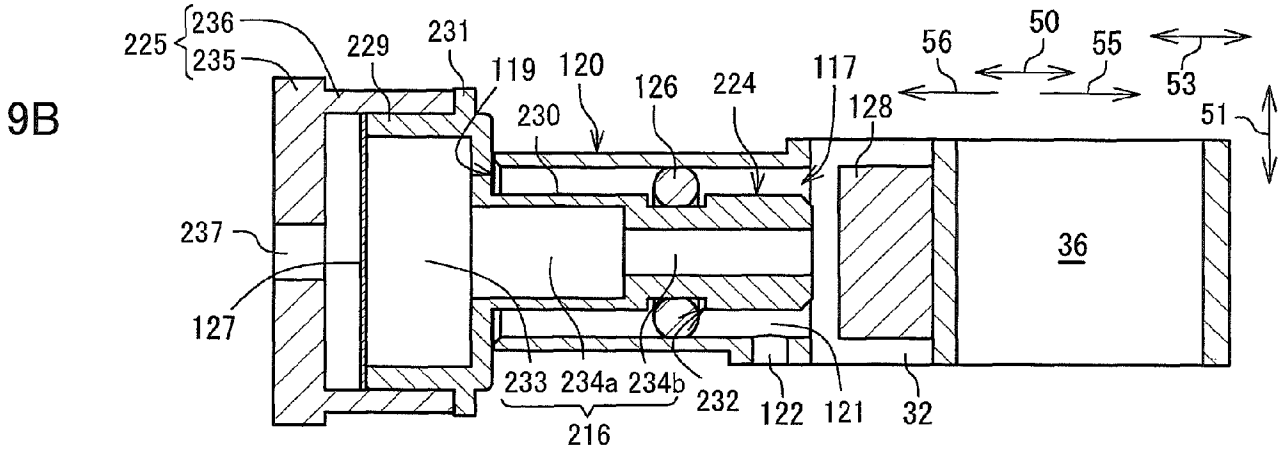
FIG. 9B is a horizontal cross-sectional view of the air communication portion according to the second embodiment when viewed from above, wherein the air passage formed in the air communication portion is opened.

The small-diameter portion 230 has an outer diameter smaller than the inner diameter of the air communication portion 120. As in the first embodiment, the small-diameter portion 230 has an outer peripheral surface in which a circumferential groove 232 is formed to receive the O-ring 126 therein, and only the O-ring 126 is in close contact with the inner peripheral wall of the air communication portion 120. On the other hand, the large-diameter portion 229 has an inner diameter larger than an outer diameter of the air communication portion 120. Hence, in the second embodiment, when the slider main body 224 is slid in the sliding direction, the large-diameter portion 229 (specifically, a downstream surface of the large-diameter portion 229 facing the aperture 119 of the air communication portion 120) is configured to abut on the protruding end of the air communication portion 120 to restrict the slider main body 224 from being slid further downstream in the sliding direction, as shown in FIG. 9B.

The through-hole 216 (large-diameter hole 233, middle-diameter hole 234*a* and small-diameter hole 234*b*) penetrating the slider main body 224 and the through-hole 237 formed in the cap 225 are in alignment with and in communication with each other to constitute a single communication hole. Put another way, the slider 223 is formed with a through-hole that penetrates therethrough in the sliding direction, as in the first embodiment.

With this structure, the same technical advantages as those of the first embodiment can be also obtained in the second embodiment.

Further, according to the slider 223 of the second embodiment, even if ink enters into the through-hole 216 of the slider main body 224, ink meniscuses are formed at two positions within the slider main body 224, i.e., one on the boundary between the small-diameter hole 234*b* and the middle-diameter hole 234*a*, and another one on the boundary between the middle-diameter hole 234*a* and the large-diameter hole 233 in the assumed ink out-flow path. Therefore, a smaller amount of ink can arrive at the semipermeable membrane 127, thereby suppressing further ink leakage from the ink cartridge 30.

<Variations>

Various modifications and variations are conceivable.

Figure 10A:
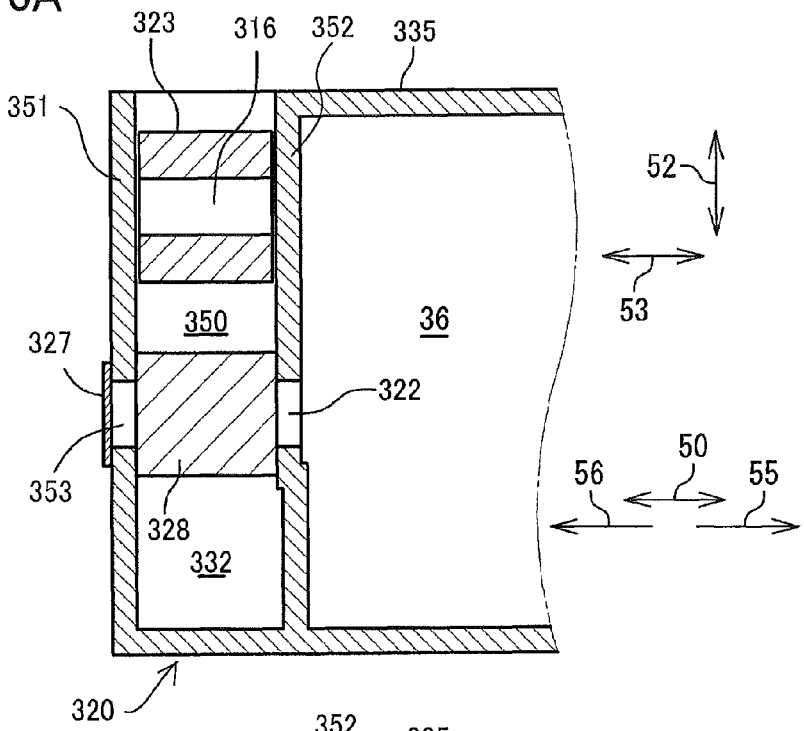
FIG. 10A is a conceptual cross-sectional view showing an air communication portion according to a variation of the present embodiment, wherein an air passage is not yet formed and thus closed in the air communication portion.
Figure 10B:
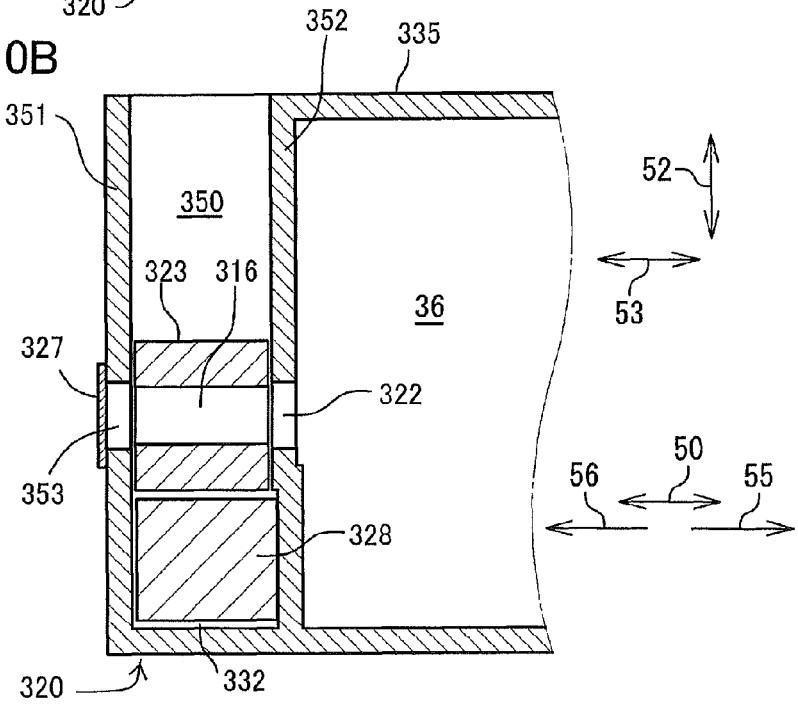
FIG. 10B is a conceptual cross-sectional view showing an air communication portion according to the variation of the present embodiment, wherein the air passage is formed and thus opened in the air communication portion.

FIGS. 10A and 10B show conceptual views of an air communication portion 320 according to a variation of the present invention.

In this variation, an inner frame 335 of the ink cartridge 30 is provided with a slider passage 350 that extends generally vertically. The slider passage 350 is defined by a pair of walls 351 and 352 extending generally vertically and spaced away from each other in the depthwise direction 53. The wall 351 serves to define an outer contour of the air communication portion 320, while the wall 352 serves as a partition between the slider passage 350 and the ink chamber 36. The wall 352 is formed with a communication port 322 to permit communication between the slider passage 350 and the ink chamber 36. The wall 351 is formed with a through-hole 353 at a position vertically corresponding to the communication port 322 (as an aperture of the air communication portion 320). In other words, the communication port 322 and the through-hole 353 are generally aligned in the depthwise direction 53. The through-hole 353 in the wall 351 is covered with a semipermeable membrane 327 from outside. The slider passage 350 has an upper end that is open, and a lower end that is in communication with a block-member accommodating chamber 332.

Within the slider passage 350, a slider 323 and a block member 328 are disposed. The slider 323 is configured to slide in a vertical sliding direction (in the height direction 52) along the slider passage 350 toward the block-member accommodating chamber 332 in the present variation. The slider 323 is disposed upward of the block member 328 (closer to the upper end of the slider passage 350) as shown in FIG. 10A. The slider 323 has an outer peripheral surface that is in close contact with an inner peripheral surface defining the slider passage 350. The slider 323 has a through-hole 316 formed therein to penetrate the slider 323 in the depthwise direction 53 that is perpendicular to the sliding direction.

As shown in FIG. 10A, unlike the block member 128 according to the first and second embodiments, the slider 323 is initially positioned to be spaced apart from the block member 328. The block member 328 is spaced away from the slider 323 at the first position shown in FIG. 10A so as to close the communication port 322 and the through-hole 353 to block air flow between the ink chamber 36 and outside.

As the slider 323 moves downstream (downward) in the sliding direction, the slider 323 is brought into contact with the block member 328 to move the block member 328 downstream in the sliding direction.

The block member 328 is finally accommodated in the block-member accommodating chamber 332 as the slider 323 further slides downstream in the sliding direction as shown in FIG. 10B. This position of the block member 328 shown in FIG. 10B corresponds to the second position in this variation. At the second position, the through-hole 316 of the slider 323 is aligned with the communication port 322 and the through-hole 353 in the depthwise direction 53 to form an air passage extending in a direction crossing the sliding direction (or a direction crossing a direction in which the slider passage 350 extends). Through this air passage constituted by the through-hole 353, through-hole 316 and communication port 322, the ink chamber 36 is allowed to communicate with ambient air.

As shown in FIG. 10B, the block-member accommodating chamber 332 has an inner diameter slightly larger than that of the in the slider passage 350 in the depthwise direction 53. Hence, the block member 328, which has once been received in the block-member accommodating chamber 332, is unlikely to move back into the slider passage 350. Also, as in the first and second embodiments, the slider 323 is unable to move the block member 328 upward (in a direction opposite to the sliding direction), since the block member 328 and the slider 323 are not connected to each other but are simply configured to abut against each other. Hence, the air communication portion 320 according to the variation is also irreversible and is never block air flow that has once been established within the air communication portion 320.

As described above, the slider is not necessarily disposed within the air passage. The sliding direction is not necessarily parallel to the direction in which the air passage extends.

Put another way, the slider may be provided in a space in communication with the air passage or in a space in which the block member is disposed. Still put another way, the slider may be disposed at such a position that the slider can abut on the block member.

While the invention has been described in detail with reference to the specific embodiment thereof, it would be apparent to those skilled in the art that various changes and modifications may be made therein without departing from the scope of the invention.

What is claimed is:

1. An ink cartridge comprising:

a cartridge body defining an ink chamber therein for storing ink;

an ink supply portion provided at the cartridge body and configured to supply the ink stored in the ink chamber to an outside;

an air communication portion provided at the cartridge body, the air communication portion having an inner peripheral wall that defines an air passage and a communication port configured to allow communication between the ink chamber and the air passage, the air communication portion having an aperture exposed to the outside and in communication with the air passage for introducing air into the air passage;

a block member configured to move from a first position to a second position, the block member at the first position being disposed in the air passage and configured to block the air passage, the block member at the second position being configured to open the air passage; and a slider configured to contact the block member and slide in a sliding direction along the air passage, wherein the block member is configured to be moved from the first position to the second position by the slider sliding in the sliding direction while contacting the block member, the slider comprising:

a first cylindrical portion having an upstream through-hole formed therein to penetrate the first cylindrical portion in the sliding direction, the upstream through-hole having a cross-sectional area larger than a cross-sectional area of the air passage when viewed in the sliding direction, the first cylindrical portion having an upstream end at which the upstream through-hole is opened;

a second cylindrical portion provided downstream of the first cylindrical portion in the sliding direction and having a downstream through-hole formed therein to penetrate the second cylindrical portion in the sliding direction such that the downstream through-hole and the upstream through-hole are in communication with each other, the second cylindrical portion having a downstream end at which the downstream through-hole is opened to be communicable with the air passage, the second cylindrical portion having a contact portion configured to be in close contact with the inner peripheral wall of the air communication portion at a position upstream of the block member at the first position in the sliding direction; and a semipermeable membrane provided at the upstream end of the first cylindrical portion to seal the upstream through-hole.

2. The ink cartridge as claimed in claim 1, wherein the second cylindrical portion is formed with a first through-hole and a second through-hole positioned downstream of the first through-hole in the sliding direction to be in communication with the first through-hole, the first through-hole and the second through-hole constituting the downstream through-hole, the second through-hole having a cross-sectional area smaller than a cross-sectional area of the first through-hole when viewed in the sliding direction.

3. The ink cartridge as claimed in claim 1, wherein the cartridge body further comprises a block-member accommodating chamber positioned downstream of the air passage in the sliding direction and configured to communicate with the air passage, the block-member accommodating chamber having a cross-sectional area larger than a cross-sectional area of a downstream edge of the air passage when viewed in the sliding direction, the block member at the second position being accommodated in the block-member accommodating chamber.

4. The ink cartridge as claimed in claim 3, wherein the slider further comprises:

a slider main body comprising the first cylindrical portion and the second cylindrical portion; and a cap coupled to the upstream end of the first cylindrical portion of the slider main body, wherein the contact portion comprises a sealing member provided on an outer peripheral surface of the second cylindrical portion of the slider main body.

5. The ink cartridge as claimed in claim 4, wherein the cap further comprises:

a lid portion having a cap through-hole formed therein to penetrate the lid portion in the sliding direction, the lid portion having a surrounding portion that surrounds the cap through-hole; and a cylindrical portion having a hollow cylindrical shape and protruding in the sliding direction from the surrounding portion of the lid portion for receiving and covering the upstream end of the first cylindrical portion, the cylindrical portion having a protruding end in the sliding direction, and wherein the first cylindrical portion has an outer peripheral surface from which a flange protrudes radially outward, the flange being in contact with the protruding end of the cylindrical portion to define a gap between the lid portion and the semipermeable membrane in the sliding direction.

6. The ink cartridge as claimed in claim 1, wherein the communication port is formed in the inner peripheral wall of the air communication portion, wherein the slider is configured to slide from a third position to a fourth position in the sliding direction to move the block member from the first position to the second position, the downstream end of the second cylindrical portion of the slider at the fourth position being positioned downstream of the communication port in the sliding direction.

* * * * *